US009187155B2

(12) United States Patent
Prins

(10) Patent No.: US 9,187,155 B2
(45) Date of Patent: Nov. 17, 2015

(54) VESSEL PROVIDED WITH A GANGWAY SUPPORTED BY A 2-DOF HINGED UPRIGHT COLUMN, IN PARTICULAR A CARDAN

(71) Applicant: Z Knowledge B.V., Ijmuiden (NL)

(72) Inventor: Reinout Klaar Norfolc Jaap Prins, Assendelft (NL)

(73) Assignee: Z Knowledge B.V., Ijmuiden (NL)

( * ) Notice: Subject to any disclaimer, the term of this patent is extended or adjusted under 35 U.S.C. 154(b) by 0 days.

(21) Appl. No.: 14/403,609

(22) PCT Filed: May 27, 2013

(86) PCT No.: PCT/NL2013/050383
§ 371 (c)(1),
(2) Date: Nov. 25, 2014

(87) PCT Pub. No.: WO2013/180564
PCT Pub. Date: Dec. 5, 2013

(65) Prior Publication Data

US 2015/0121635 A1 May 7, 2015

(30) Foreign Application Priority Data

Jun. 1, 2012 (NL) ..... 2008920

(51) Int. Cl.
*B63B 17/00* (2006.01)
*B63B 27/14* (2006.01)
*B63B 27/30* (2006.01)

(52) U.S. Cl.
CPC ..... *B63B 27/14* (2013.01); *B63B 27/30* (2013.01); *B63B 2027/141* (2013.01)

(58) Field of Classification Search
USPC ..... 14/69.5; 114/362
IPC ..... B63B 27/46,27/146
See application file for complete search history.

(56) References Cited

U.S. PATENT DOCUMENTS

| | | | | |
|---|---|---|---|---|
| 6,347,424 | B1 * | 2/2002 | Vatne | 14/69.5 |
| 2012/0024214 | A1 * | 2/2012 | Koppert | 114/261 |

FOREIGN PATENT DOCUMENTS

| | | | |
|---|---|---|---|
| EP | 1315651 | B1 | 8/2006 |
| GB | 2163402 | A | 2/1986 |
| NL | 1027103 | C2 | 3/2006 |
| WO | 2007/120039 | A1 | 10/2007 |

* cited by examiner

*Primary Examiner* — Stephen Avila
(74) *Attorney, Agent, or Firm* — Hoffmann & Baron, LLP

(57) ABSTRACT

A vessel with bridging means includes an upright column, a gangway, a first hinge connection for hingedly connecting the gangway to the column, coupling means at or near a free end of the gangway for coupling the gangway to an offshore construction, and one or more gangway support organs. The column is supported by and connected to the vessel by means of a second hinge connection designed to allow the vessel to rotate relative to the column in a first rotation direction around an x-axis and in a second rotation direction around an y-axis, wherein the x- and y-axes extend substantially horizontal and orthogonal relative to each other. Positioning means are provided which comprise force actuators between the vessel and the column for swiveling the column around the second hinge connection relative to the vessel around said x- and y-axis.

14 Claims, 4 Drawing Sheets

VESSEL PROVIDED WITH A GANGWAY SUPPORTED BY A 2-DOF HINGED UPRIGHT COLUMN, IN PARTICULAR A CARDAN

CROSS-REFERENCE TO RELATED APPLICATIONS

This application is the National Stage of International Application No. PCT/NL2013/050383 filed May 27, 2013, which claims the benefit of Netherlands Application No. NL 2008920, filed Jun. 1, 2012, the contents of which is incorporated by reference herein.

FIELD OF THE INVENTION

The invention relates to a vessel which is provided with bridging means for transferring persons and/or cargo to an offshore construction.

BACKGROUND OF THE INVENTION

The transfer of cargo from a vessel towards an offshore construction in general takes place with a hoisting crane. The cargo then for example is placed upon a pallet or inside a crate which hangs down at hoisting cables and needs to be put down at a loading platform which is positioned at a considerable height above the water level, in particular above the maximum expected wave height. If there is no crane on the offshore platform itself, then a hoisting crane of the vessel needs to be present. Such a vessel crane in general is a special (heavy) crane which is preferably capable of compensating vessel movements to a certain degree. The vessel movements in relation to weather conditions however still limit the use of such cranes. Furthermore the pendulum effect of the hoisting cables limit the weight of the cargo which can be transferred. Also this type of cargo transfer can not be used towards unmanned offshore constructions.

The transfer of people from a vessel towards an offshore construction in general takes place via a gangway as bridging element placed in between them. For example EP-1 315 651 shows a transfer system for positioning a telescopingly extendable gangway with a fixed and a movable gangway section between a vessel and an offshore construction. A hydraulic piston extends between the fixed and movable gangway sections and is able to adjust the total length of the gangway. The fixed gangway section is pivotally connected, around a horizontal rotation axis, to an upper end of an upright supporting column by means of a hinge connection. A hydraulic piston extends between the supporting column and the fixed gangway section and is able to adjust the angle of inclination of the gangway. The supporting column itself is rotatably mounted, around a vertical rotation axis, on the deck of the vessel by means of a turntable. Hydraulics is provided for adjusting the rotational position of the assembly of the column and gangway around the turntable relative to the vessel. The movable gangway section at its free end is provided with hydraulically operable coupling claws which are designed to be coupled to a substantially vertical gripping bar which is mounted to the offshore construction.

During coupling the vessel is sailed and maneuvered to a suitable starting position relative to the offshore construction. Subsequently the gangway by means of suitable steering of the respective hydraulics is swiveled/rotated such that it is directed towards a center part of the gripping bar. Then the gangway is extended until the coupling device is able to enclose the gripping bar. At that moment the coupling claws are moved from an open position towards a closed position.

The closing is such that the claws still have the freedom to slide upwards along the gripping bar. As soon as an aimed coupling position along an upper part of the gripping bar just beneath a loading platform is reached, the coupling claws are moved further towards each other in order to fixedly clamp the gripping bar there. Finally, all the hydraulics for positioning the gangway are set free, such that the gangway is freely able to extend or retract, change its angle of inclination around the horizontal rotation axis, and/or change its rotational turntable position around the vertical rotation axis. The vessel then at the same time is kept in place by means of a suitable driving of thrusters or the like in dependency of satellite navigation. Thus no big forces are exerted on the gangway and the gripping bar.

A disadvantage with this known transfer system is that it is less suitable to transfer heavy cargo loads of for example 2 tons or more from the vessel towards the offshore construction and vice versa. In particular during heavy weather conditions this could easily result in too big forces occurring on the gangway and supporting column. This in turn would require the gangway and supporting column to be constructed relative strong and heavy. Furthermore a coupling under heavy weather conditions may be somewhat difficult. Forces which occur at the time that the gangway hits the coupling bar are difficult to manage under such conditions.

SUMMARY OF THE INVENTION

The present invention aims to overcome one or more of those disadvantages at least partly or to provide a usable alternative. In particular the invention aims to provide a user-friendly and relative light-weight transfer system which is able to transmit forces more equally into the construction.

This aim is achieved by means of a vessel with bridging means for transferring persons and/or cargo to an offshore construction according to the present invention. The vessel comprises an upright column extending upwards from the vessel, and a gangway, in particular a telescopically extendable gangway, which extends sideways from the column. A first hinge connection is provided for hingedly connecting the gangway to the column. Furthermore coupling means are provided at or near a free end of the gangway for coupling the gangway to the offshore construction, and one or more support organs are provided for supporting the gangway relative to the column in its sideways extending position. According to the inventive thought the column is supported by and connected to the vessel by means of a specific type of second hinge connection. This second hinge connection is chosen such that it is able to have the vessel rotate relative to the column in both a first rotation direction around an x-axis as well as in a second rotation direction around an y-axis, wherein those x- and y-axes both extend substantially horizontally, and wherein those x- and y-axes extend orthogonal relative to each other. Positioning means are provided which comprise force actuators between the vessel and the column for swiveling the column around the x- and y-axes of the second hinge connection relative to the vessel.

This specific type of 2-DOF hinge support of the column on the vessel together with the provision of the force actuators acting in those same 2-DOF's advantageously make it possible to provide a gangway supporting column, of which a desired orientation, in particular a desired substantially vertical orientation, can be maintained under all circumstances whatever pitching or rolling movements the vessel makes on the waves. Each time the column leaves its desired orientation, the force actuators can be actuated in such a way that the column is quickly and smoothly brought back into its desired orientation. The force actuators do not have to bear the weight of the column, this weight can be carried by the second hinge connection. The force actuators merely serve the purpose of keeping the column in its desired upright orientation.

The second hinge connection is of the type having at least two rotational degrees-of-freedom (DOF) whereas shifting displacements between the vessel and the column at the location of the second hinge connection are counteracted, and whereas forces, like weight forces, can be transmitted from the column towards the vessel and vice versa. The second hinge connection can take up forces not only in a downward direction but also in the sideways directions without allowing relative displacements of the second hinge connection itself in those directions. The second hinge connection thus forms a true 2-D pivotal connection between the column and the vessel.

Persons and cargo can now first be transported from the second hinge connection upwards along the column towards the first hinge connection, and from there be transferred over the gangway towards the offshore construction. When coupled to the offshore construction, the gangway is supported at both ends between the column and the offshore construction, and forms a reliable bridge between them. The permanent vertical positioning of the column herewith helps to prevent or minimize uncontrollable acceleration forces in horizontal directions caused by sudden pitching or rolling vessel movements. Such forces could otherwise lead to uncontrollable situations in which the vessel might even capsize. The only substantial movement the column makes is a vertical movement up and down together with the vessel. This vertical movement within certain boundaries is no problem since it can easily be absorbed by the gangway changing its angle of inclination around the first hinge connection.

Since forces which occur during transfer of persons and cargo can now be entered more equally into the column-gangway construction, this can be constructed more lightweight. Also lighter vessels can now be used for the transfer. Furthermore it is noted that height differences between the vessel and a landing platform on the offshore construction, in particular height differences of more than 18 meters, can now be overcome more easily. A transfer of heavy loads is now also possible during heavy weather.

In a particular embodiment the second hinge connection comprises two substantially horizontal orthogonal pivot pins. Those two pivot pins may form part of a so-called Universal or Cardan joint or an assembly of two Gimbals also referred to as a two-axis Gimbal. The Universal joint, Cardan joint or Gimbal assembly allows the column and vessel to swivel around both the x- and y-axes relative to each other. The pivot pins are located close together and preferably lie in a same common substantially horizontal plane. They form a double-pivoted support that allows the rotation of the column and vessel relative to each other about two respective axes. With the Universal joint, the Cardan joint and the Gimbal assembly, the column can be mounted on one of the pivot pins, whereas the vessel can be mounted to the other remaining pivot pin. Together the pivot pins of the second hinge connection are well able to keep the column substantially immobile with respect to its upright orientation relative to the horizon regardless of the pitching and rolling motions of the vessel.

In another embodiment the second hinge connection can further be designed to allow the vessel to rotate relative to the column in a third rotation direction around a z-axis, wherein the z-axis extends substantially vertical and orthogonal relative to the x- and y-axes. This gives the second hinge connection 3-degrees-of-freedom for rotation in all directions around the x-, y- and z-axes. The column now can not only swivel around its substantially horizontal pivot pins, but also is able to swing the gangway towards different directions. A possible type of hinge connection for this is a ball-and-socket joint. Preferably, however the second hinge connection, besides comprising the two substantially horizontal pivot pins, further comprises a turntable which is rotatable around the z-axis. This turntable then preferably is positioned underneath a bottom end of the column and above the two substantially horizontal pivot pins.

In a further embodiment lever arms can be provided which are fixedly connected to the column or, if present, to the mentioned turntable. Those lever arms extend in a substantially sideways direction. The force actuators are provided in between the vessel and the lever arms. The lever arms make it possible to use less strong force actuators.

The force actuators can be of various types, like spindles, stays which can be tensioned or loosened, etc. Preferably, hydraulic cylinders are used since they are able to respond very quickly and thus are able to prevent the column from swinging around too much.

The force actuators can be driven manually. Preferably however the positioning means are automated. For this the positioning means further comprise a position sensor for sensing the orientation of the column relative to the horizon, in particular for sensing deteriorations of the column from a substantially vertical orientation. Furthermore a control unit then is provided for automatically steering the force actuators in dependence of sensed orientations by the position sensor in such a way that the force actuators bring the column back to its aimed upright orientation, in particular back to its substantially vertical orientation. Depending on the rolling and pitching speed of the vessel, the column in this way can be kept within +/−2 degrees from the vertical until wind-force 8.

The column can have all kinds of lengths depending on the expected situations, tides, etc. Preferably, the column at least has a height of 5 meters, in particular at least 10 meters.

Persons can reach the gangway via stairs or the like. In a specific embodiment a lift can be provided which is movable up and down along the column between the vessel and the gangway. Advantageously the column can then be provided with guiding means for the lift. By keeping the orientation of the column substantially vertical, an upwards travel of the lift together with a number of persons and/or heavy cargo does not lead to tilting forces being exerted on the vessel. This makes the transfer system rather safe even during storm and high waves. The lift further makes it possible to use small wheeled carts for transferring the cargo.

In a further embodiment the first hinge connection can be adjusted in height on several points along the column. By this adjustment the position of the gangway, and more specifically its angle during installation and operation, can be adapted and optimized in relation to the height position of the complementary coupling means and support point respectively on the stationary offshore construction towards the vessel as tidal differences may influence this relation.

In an advantageous embodiment, the vertical adjustment of the gangway along the column can be guided and controlled by connecting the gangway temporarily with the lift in order to bring its first hinge connection to a another level and corresponding hinge point on the column. In a similar manner it is also possible to lower the gangway fully downwards onto the level of the vessel deck during sailing over large distances and/or during heavy seas.

Further preferred embodiments are stated in the dependent subclaims.

The invention also relates to an assembly of the above described vessel transfer system together with an offshore construction which is equipped with complementary coupling means, as well as to a coupling method of the vessel to such an offshore construction.

BRIEF DESCRIPTION OF THE DRAWINGS

The invention shall be explained in more detail below with reference to the accompanying drawings, in which.

DETAILED DESCRIPTION OF THE INVENTION

Figure 1:
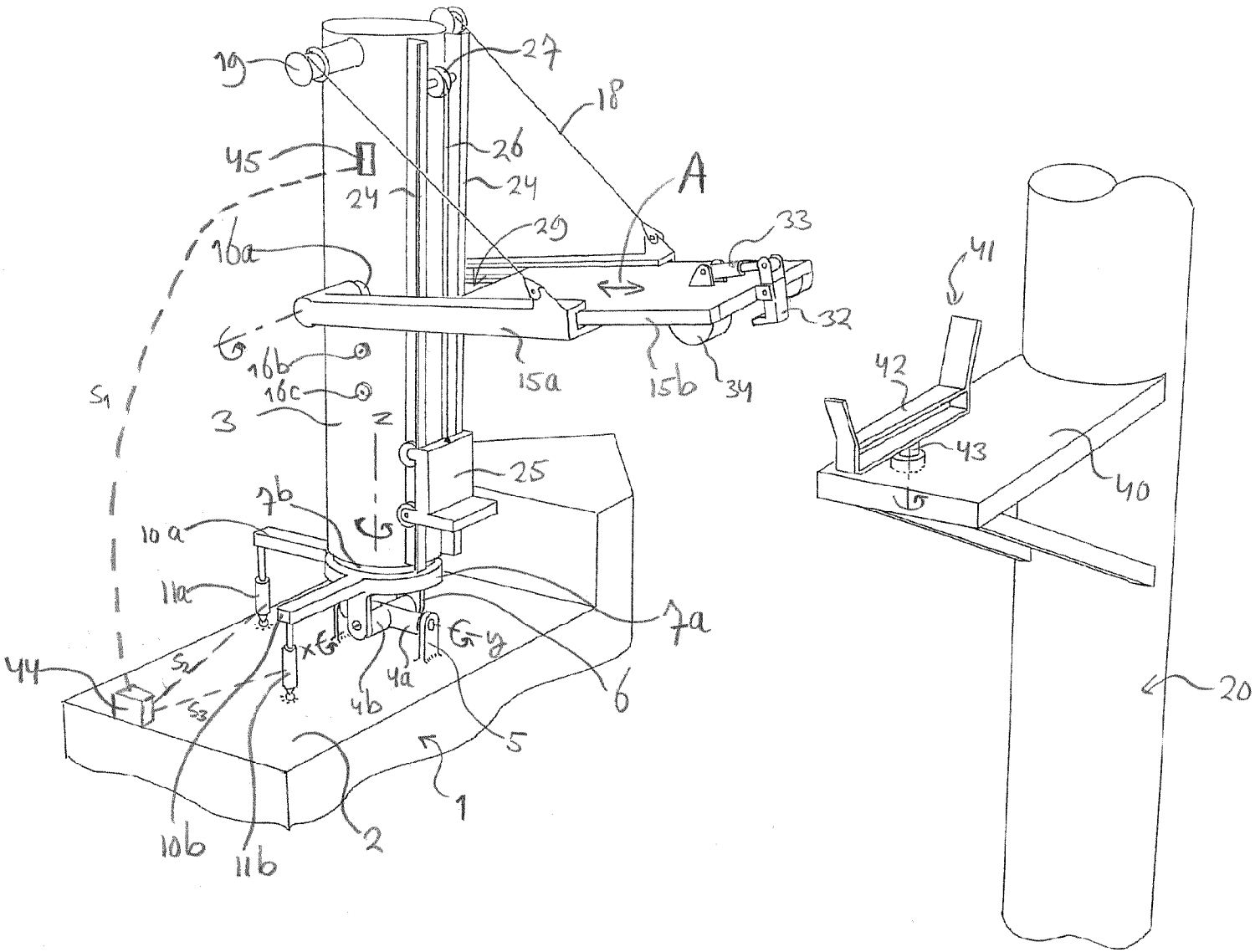
FIG. 1 is a schematic perspective view of an assembly of a vessel and offshore construction according to the invention in an uncoupled position.

In FIG. 1 the vessel is given the reference numeral 1. The vessel 1 is provided with an upper deck 2 on top of which a supporting column 3 is placed. Between the column 3 and the vessel a Cardan joint 4 is provided. The Cardan joint 4 forms a hinge connection (the so-called second hinge connection) which has two pivot pins 4*a*, 4*b* extending in the horizontal directions x and y and allowing the vessel and column to rotate relative to each other around those x- and y-axes. An angle of 90 degrees is enclosed between the two pivot pins 4*a*, 4*b*.

The pivot pin 4*a* is supported by brackets 5 which are fixedly connected to the vessel 1. The pivot pin 4*b* is supported by brackets 6 which are fixedly connected to a fixed ring segment 7*a* of a turntable 7. The turntable 7 further comprises a rotatable ring segment 7*b* which is connected to a lower end of the column 3 and which is rotatable relative to the fixed segment 7*a* around a z-axis. This z-axis extends in the vertical direction and encloses angles of 90 degrees with both pivot pins 4*a*, 4*b*.

The fixed ring segment 7*a* is equipped with two lever arms 10, a first one 10*a* extending in the y-direction, and a second one 10*b* extending in the x-direction. Between outer ends of the lever arms 10 and the vessel, hydraulic cylinders 11*a*, 11*b* are placed. Those cylinders 11 may be pivotally mounted with one side to the lever arms 10 and at their other side to the vessel 1. When operated, the hydraulic cylinders 11 are lengthened or shortened and force the column 3 to rotate/swivel around the x- and/or y-axis relative to the vessel 1.

Approximately halfway the column 3, that is to say at a height h1 of between 5-25 meter, a gangway 15 is hingedly connected by means of a hinge connection (the so-called first hinge connection) which has a single pivot pin 16*a* which extends in a horizontal direction and which allows the gangway 15 and column 3 to rotate relative to each other around this horizontal axis when the gangway 15 is coupled to this pivot pin 16*a*. In the embodiment shown a plurality of pivot pins is provided, in which pivot pins 16*b*, 16*c* are provided at other heights h2, h3 along the column 3. By connecting the gangway 15 to a specific desired one of the pivot pins 16*a-c* it can be achieved that the gangway 15 is able to take and maintain a specific average angle of inclination during coupling.

The gangway 15 comprises a fixed gangway section 15*a* and a telescoping gangway section 15*b*. The telescoping gangway section 15*b* can slide in and out of the fixed gangway section 15*a* in the direction A. Between the two sections (hydraulic) drive means can be provided for actively lengthening or shortening the gangway 15 whenever desired, in particular during a coupling action to an offshore construction 20.

The gangway 15 is hung to the column 3 by means of cables 18 which are run over a hoisting device 19. Thus the angle of inclination of the gangway 15 can actively be altered whenever desired, in particular during a coupling action to the offshore construction 20.

Along the column 3, guide rails 24 are provided along which a lift 25 is guided with pairs of wheels. The lift 25 is hung to the column by means of a cable 26 which is run over a hoisting device 27. Thus the lift 25 can be moved up and downwards along the column 3, in particular between the vessel deck 2 and the gangway 15. The gangway 15 is provided with an opening 29 which allows the lift 25 to pass through and get leveled with the gangway 15.

At its outer free end the gangway 15 is provided with a coupling hook 32 which is operable between an open and closed position by means of a hydraulic cylinder 33. Rounded bumper/cushioning elements 34 are provided underneath the gangway 15.

The offshore construction 20, which is also schematically shown in FIG. 1, comprises a pole of a wind turbine or the like surrounded by the sea. A landing platform 40 is provided at the offshore construction 20 which platform is equipped with coupling means 41 complementary to the coupling hook 32. Those complementary coupling means 41 on the offshore construction 20 comprises a substantially U-shaped supporting element 42 which is pivotally connected to the construction 20 by means of a pivot pin 43 having a vertical rotation axis.

Figure 2:
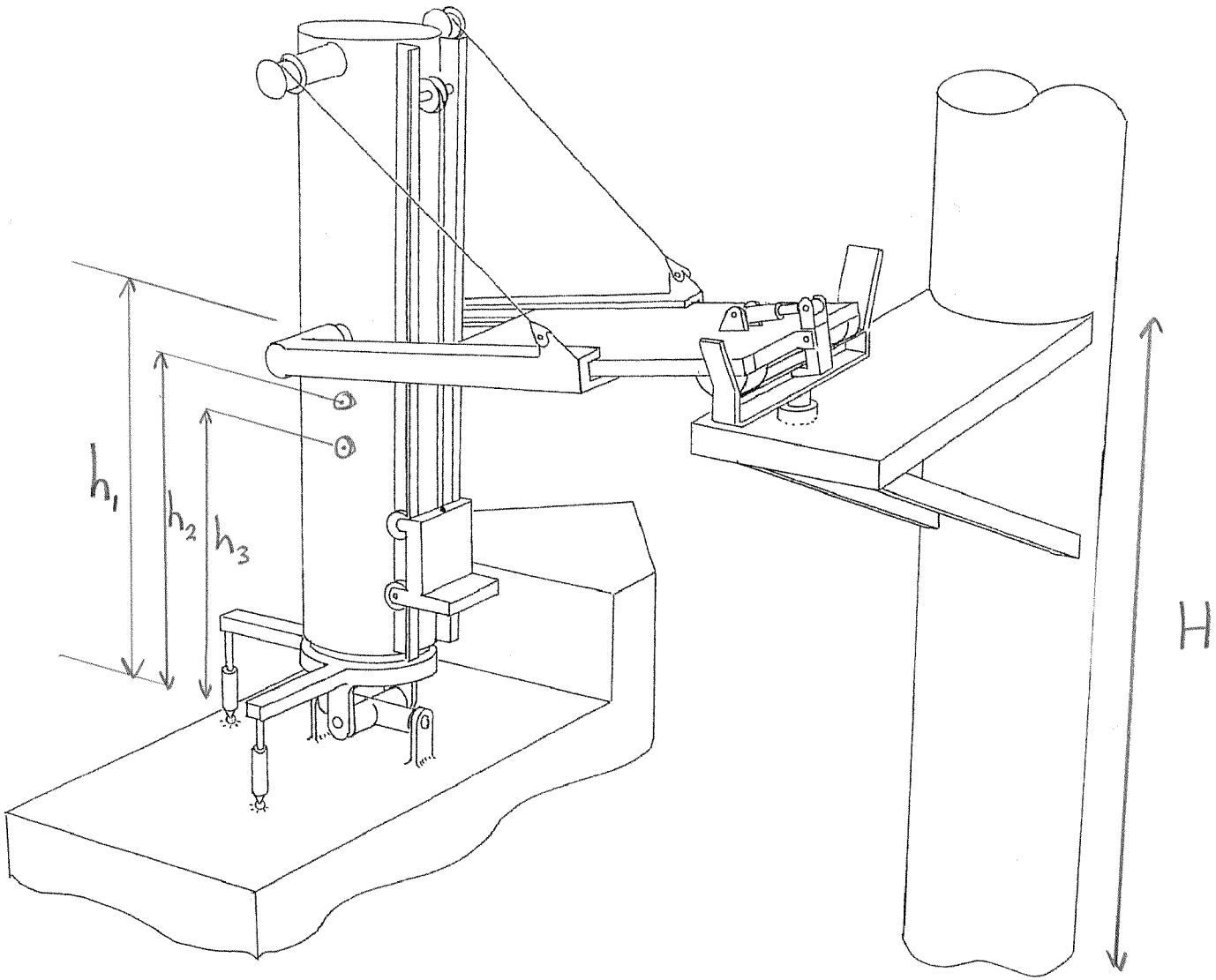
FIG. 2 is a view according to FIG. 1 in a coupled position.

A possible method for coupling the gangway 15 to the offshore construction 20 shall now be explained with reference to FIG. 1-3. In FIG. 1 it is shown that the vessel 1 has been sailed to a position near the offshore construction 20. If necessary the column 3 can be rotated around the turntable 7 in order to get the gangway 15 to point with its outer end towards the offshore construction 20. If necessary, for example depending on the water level of the sea, it is also possible to operate the hoisting device 19 in order to raise or lower the gangway 15 in such a way that the gangway 15 gets to point towards the coupling means 41. Subsequently the gangway 15 can be extended until the coupling hook 32 comes to lie behind the supporting element 42. By subsequently retracting the gangway 15, the hook 32 automatically gets to grip behind the supporting element 42. During the entire coupling process the hook 32 can be kept in its closed position as is shown in FIGS. 1 and 2. In this closed position it is positioned such that it leaves an opening free which is large enough for the supporting element 42 to enter it. In this closed position the bumper/cushioning element lies upon the supporting element 42. The hook only needs to be brought into its open position in case uncoupling is desired or in case of emergency. The cylinder 33 can then be retracted, which causes the hook 32 to rotate upwards and no longer grip behind the supporting element 42.

As soon as the coupling is made, the gangway 15 is given the full freedom to extend or retract such that the distance between the vessel 1 and the offshore construction 20 can change somewhat. At the same time the hoisting devices 19 for the cables 18 are set free such that the gangway 15 is free to alter its angle of inclination, which gives the vessel 1 the freedom to rise up and downwards somewhat together with the waves. Furthermore the turntable 7 is given the full freedom to rotate around the z-axis such that the vessel 1 is given the freedom to turn left or right.

As shown in FIG. 2, in the coupled position, the gangway 15 projects slightly slanting upwards, in particular with an angle of between 0-20 degrees. In this way it is prevented that the hook 32 unhooks from the supporting element 42. This slightly upwardly slanting positioning of the gangway 15 is obtained by having the first hinge connection 16 between the gangway 15 and the column 3 positioned at a height h slightly lower, in particular 0-10 meter lower, than the height H of the coupling means 41 on the offshore construction.

According to the invention the column 3 maintains to be vertically orientated both during coupling and after the coupling has been made. For this operation of the hydraulic cylinders 11 may be necessary. Depending on the amount and direction of rolling or pitching movements the vessel 1 makes, the hydraulic cylinders 11 need to be adjusted in length in order to have the column 3 maintain its vertical orientation. This is obtained by means of a control unit 44 which receives sensor signals s1 of a position sensor 45 which is built into the column 3. Whenever the control unit receives a signal s1 of the sensor 45 that the column 3 has left its vertical orientation, it immediately sends out corresponding signal s2 or s3 to the hydraulic cylinders 11 to change their length(s) and with this exert suitable forces to the column 3 in order to have it move back towards its aimed vertical orientation.

Figure 3:
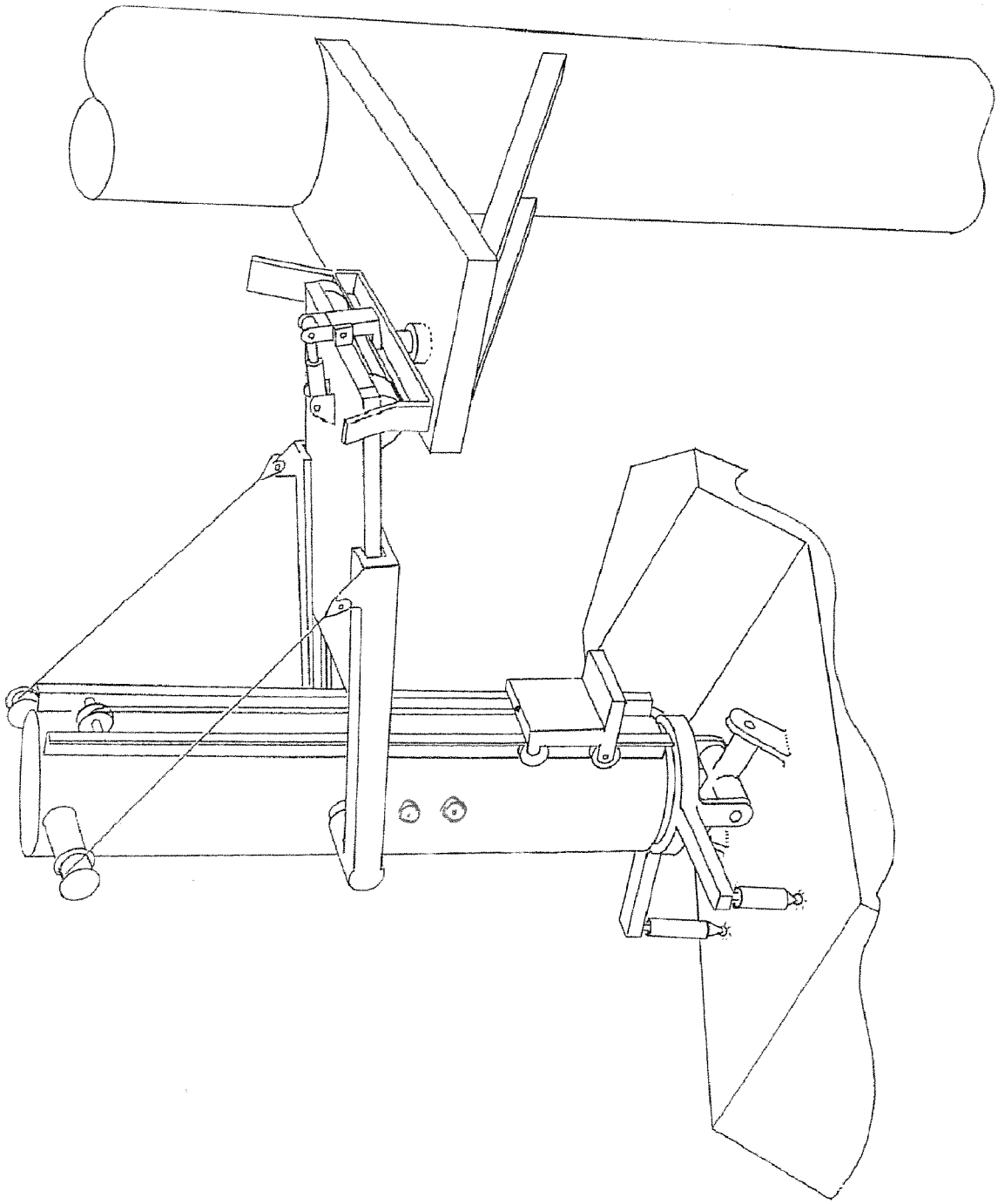
FIG. 3 is a view according to FIG. 1 showing the permanent vertical orientation of the column with the vessel moving beneath it.

An example hereof is shown in FIG. 3 where both hydraulic cylinders 11 have been operated towards shortened lengths such that a slanting position of the vessel 1 is compensated in such a way that the column is orientated vertical again. In a similar manner the hydraulic cylinders 11 can be operated over and over again each time that it is necessary to make a correction in order to have the column 3 maintain its vertical orientation.

Figure 4:
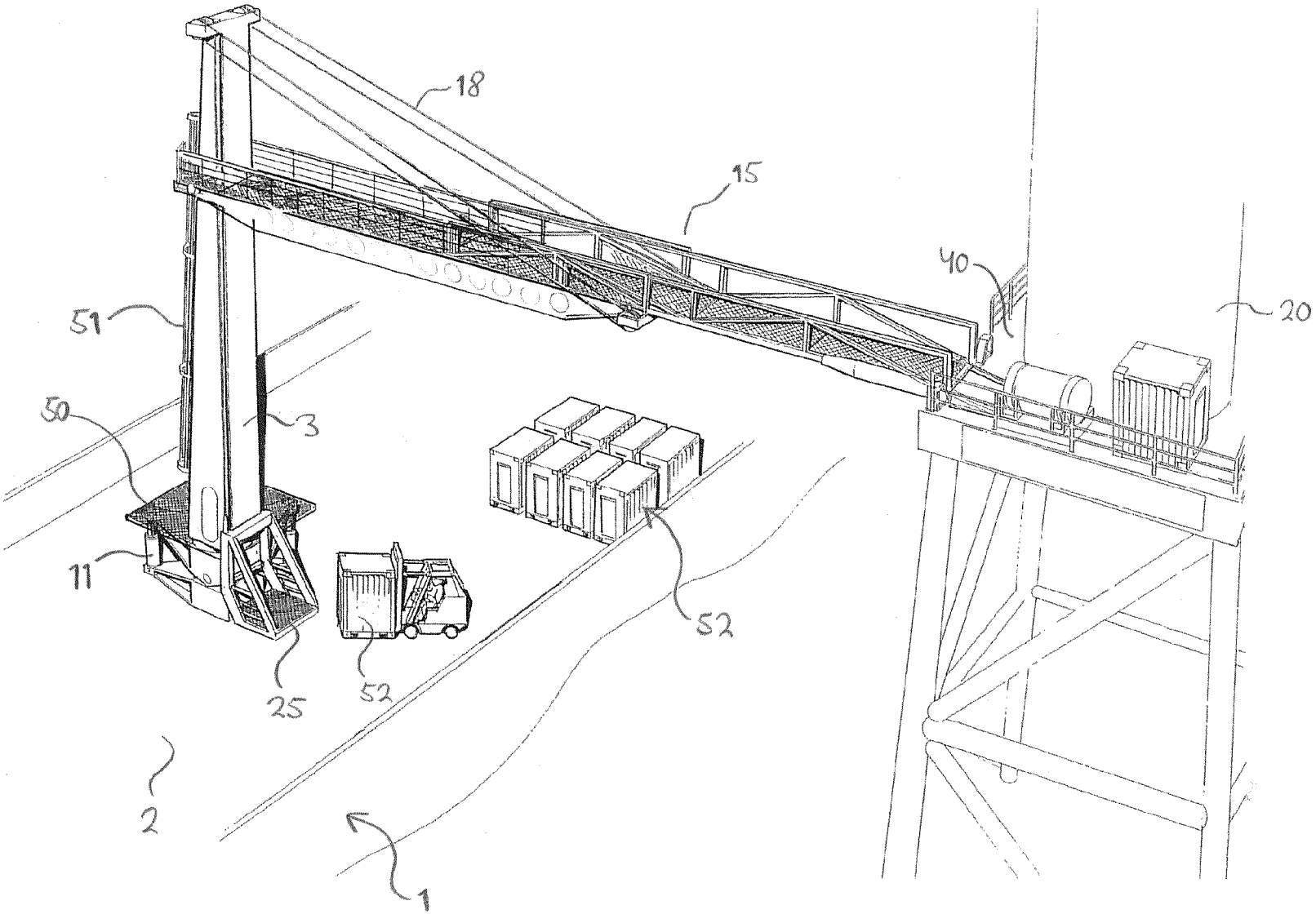
FIG. 4 shows a variant of FIG. 1 in a coupled operating situation during transfer of cargo.

In FIG. 4 a variant is shown in which the hydraulic cylinders 11 now act upon a platform 50 which is mounted to the column 3. Furthermore in this embodiment safety stairs 51 are provided along the column 3. In this FIG. 4 it can also be seen how according to the invention relative large and/or heavy cargo containers 52 can now be easily picked and placed upon the lift 25 and subsequently be transferred upwards to the beginning of the gangway 15 and form there be rolled over the gangway 15 towards the landing platform 40 on the offshore construction 20.

Besides the embodiments shown numerous variants are possible. For example the dimensions and shapes of the various parts can be varied, and instead of hydraulic cylinders between the vessel and the column other types of force actuators can be used. Instead of the gangway being hung in cables it is also possible to have it supported by other types of gangway support organs, for example by means of hydraulic cylinders. Instead of the hook organ other types of coupling means can be provided at or near the free end of the gangway. For example coupling means which include one or more DOF's and/or hinge axes. Also coupling means may be used which are releasably connected to complementary coupling means on the offshore construction, like a clamp or the like.

Thus the invention provides for an effective, user-friendly and save transfer system with which persons and all kinds of cargo can be quickly transferred from a vessel towards an offshore construction even at heavy sea or otherwise difficult conditions.

The invention claimed is:

1. A vessel with bridging means for transferring persons and/or cargo to an offshore construction, comprising:

an upright column extending upwards from the vessel;

a gangway, in particular a telescopically extendable gangway, extending sideways from the column;

a first hinge connection for hingedly connecting the gangway to the column;

coupling means at or near a free end of the gangway for coupling the gangway to an offshore construction; and one or more gangway support organs for supporting the gangway relative to the column in its sideways extending position, wherein the column is supported by and connected to the vessel by means of a second hinge connection designed to allow the vessel to rotate relative to the column in a first rotation direction around an x-axis and in a second rotation direction around an y-axis, wherein the x- and y-axes extend substantially horizontal and orthogonal relative to each other, and wherein positioning means are provided which comprise force actuators between the vessel and the column for swiveling the column around the second hinge connection relative to the vessel around said x- and y-axis.

2. The vessel according to claim 1, wherein the second hinge connection comprises two substantially horizontal orthogonal pivot pins.

3. The vessel according to claim 2, wherein the two pivot pins form part of a Universal joint, Cardan joint or a Gimbal assembly.

4. The vessel according to claim 2, wherein the second hinge connection is further designed to allow the vessel to rotate relative to the column in a third rotation direction around a z-axis, wherein the z-axis extends substantially vertical and orthogonal relative to the x- and y-axes.

5. The vessel according to claim 4, wherein the second hinge connection further comprises a turntable rotatable around the z-axis.

6. The vessel according to claim 1, wherein lever arms are provided which are fixedly connected to the column and extend in a substantially sideways direction from it, the force actuators being provided in between the vessel and the lever arms.

7. The vessel according to claim 1, wherein the force actuators are hydraulic cylinders.

8. The vessel according to claim 1, wherein the positioning means further comprise:

a position sensor for sensing the upright orientation of the column relative to the horizon, in particular for sensing deteriorations of the column from a substantially vertical orientation; and a control unit for steering the force actuators in dependence of sensed orientation by the position sensor such that the force actuators bring the column back to its aimed upright orientation, in particular its substantially vertical orientation.

9. The vessel according to claim 1, wherein the one or more gangway support organs comprise cables for hanging the gangway.

10. The vessel according to claim 1, wherein a hoist is provided for shortening or lengthening the cables.

11. The vessel according to claim 1, wherein a lift is provided which is movable between the vessel and the gangway, and wherein the column is provided with guiding means for the lift.

12. The vessel according to claim 1, wherein the column has a height of at least 5 m.

13. The vessel according to claim 1, wherein the first hinge connection is provided between an intermediate part of the column and the gangway.

14. An assembly of a vessel according to claim 1 and an offshore construction, wherein the offshore construction is provided with coupling means which are complementary to the coupling means at or near the free end of the gangway.

* * * * *